US005783053A

United States Patent [19]

Tomba et al.

[11] Patent Number: 5,783,053

[45] Date of Patent: *Jul. 21, 1998

[54] COMBINATION INNER PLATE AND OUTER ENVELOPE ELECTRODE

[75] Inventors: Charles P. Tomba, Painesville; Joseph J. Scarpucci; Andy W. Getsy, both of Eastlake, all of Ohio

[73] Assignee: Eltech Systems Corporation, Chardon, Ohio

[ * ] Notice: The term of this patent shall not extend beyond the expiration date of Pat. No. 5,464,519.

[21] Appl. No.: 797,146

[22] Filed: Feb. 10, 1997

Related U.S. Application Data

[60] Continuation of Ser. No. 543,679, Oct. 16, 1995, Pat. No. 5,619,793, which is a division of Ser. No. 160,632, Dec. 2, 1993, Pat. No. 5,464,519.

[51] Int. Cl.[6] ..... C25B 11/02; C25B 11/10; H01R 43/02

[52] U.S. Cl. ..... 204/280; 204/279; 204/290 F; 29/877; 29/879; 29/402.09; 29/402.16

[58] Field of Search ..... 29/402.01, 402.09, 29/402.16, 897.1, 879, 876, 877, 878; 219/121.11, 121.14, 121.46, 148; 156/91, 94, 306.3; 204/280, 290 R, 279, 290 F

[56] References Cited

U.S. PATENT DOCUMENTS

| | | | |
|---|---|---|---|
| 3,265,526 | 8/1966 | Beer | 117/50 |
| 3,632,498 | 1/1972 | Beer | 204/290 F |
| 3,711,385 | 1/1973 | Beer | 204/59 |
| 3,761,384 | 9/1973 | Ruthel et al. | 204/288 |
| 3,761,385 | 9/1973 | Ruthel et al. | 204/290 F |
| 3,891,531 | 6/1975 | Bouy et al. | 204/263 |
| 3,928,167 | 12/1975 | Buoy et al. | 204/286 |
| 3,940,328 | 2/1976 | Thomas et al. | 204/283 |
| 4,022,679 | 5/1977 | Koziol et al. | 204/286 |
| 4,078,986 | 3/1978 | Smith | 204/258 |
| 4,171,254 | 10/1979 | Koenecke | 204/197 |
| 4,528,084 | 7/1985 | Beer et al. | 204/290 F |
| 4,657,652 | 4/1987 | Hodges | 204/269 |
| 5,135,633 | 8/1992 | Kotowski et al. | 204/286 |
| 5,464,519 | 11/1995 | Tomba et al. | 204/280 |
| 5,619,793 | 4/1997 | Tomba et al. | 29/879 |

FOREIGN PATENT DOCUMENTS

| | | |
|---|---|---|
| 855192 | 11/1970 | Canada . |
| 2164495 | 3/1973 | France . |
| 2143784 | 9/1973 | France . |
| 2267389 | 7/1975 | France . |
| 1076973 | 7/1967 | United Kingdom . |
| 1468670 | 3/1977 | United Kingdom . |

OTHER PUBLICATIONS

French Search Report Dated Mar. 18, 1996 issued in French Application Serial No. 94 14 526.

*Primary Examiner*—Bruce F. Bell
*Attorney, Agent, or Firm*—John J. Freer; David J. Skrabec

[57] ABSTRACT

Electrodes in plate form can be electrocatalytically coated and secured to a current distributor, such as by welding to a base plate, and may be serviceable, e.g., as anodes, in cells electrolyzing brine. Recoating of plate electrodes can require removal from the cell, removal of old coating, application of fresh coating, then returning and securing the freshly coated electrodes to the cell. There are now provided envelopes for covering the original electrode plates. The original plates thus do not need to be separated from a base member of the cell. The envelopes can have an electrocatalytic coating on their outer surfaces. The resulting electrodes are thus a combination of an old inner plate and a new outer envelope, with an outer surface coating on the envelope. The envelopes can be secured to the inner plate and/or to a current distributor such as a base plate.

20 Claims, 2 Drawing Sheets

COMBINATION INNER PLATE AND OUTER ENVELOPE ELECTRODE

This is a continuation, of application Ser. No. 08/543,679, filed Oct. 16, 1995, now U.S. Pat. No. 5,619,793 which is a divisional of Ser. No. 08/160,632, filed Dec. 2, 1993, now U.S. Pat. No. 5,464,519, issued Nov. 7, 1995.

BACKGROUND OF THE INVENTION

In cells such as chlorate cells for the production of chlorate by the electrolysis of brine, it has been known to use coated titanium anodes. The anodes can comprise a plurality of spaced-apart members and the members can be positioned side-by-side in parallel rows. The anode members can be connected together and such connections can be by members taking different forms such as ribs and base plates. These connecting members, which may be positioned in a manner transverse to parallel rows of anodes may serve as current distributors for impressing an electrical current onto the anode members.

It has been known that the titanium anodes may carry a coating, such as an electrocatalytic coating of a platinum group metal oxide, with the anodes being in the form of plates. For example, British Patent No. 1,076,973 discloses titanium plate anodes, which plate anodes are in parallel rows, side-by-side and spaced apart one from the other. The plate anodes can have an electrocatalytic coating and, as shown in the patent, a transverse rib member serving as a current distributor or busbar.

U.S. Pat. No. 4,022,679 discloses titanium described in the form of bands or strips which are coated and serve as anodes. The bands or strips run parallel to one another and are spaced apart from each other. Current is distributed to these parallel rows of titanium strips by a transverse bar of uncoated titanium which is welded to the strips.

For distributing current to the electrodes, the distributor may be in the form of a sheet or a plate, sometimes referred to as the base plate of the cell. U.S. Pat. No. 4,078,986 shows a titanium sheet serving as a base plate of a cell. To the base plate, there are welded parallel rows of support ribs and from these ribs there extend anodes in sheet form. These anodes may be fabricated of titanium and provided with an electrocatalytically active coating. The sheet anodes are welded to the ribs.

In these various constructions when it is time to recoat the anodes, it has been conventional to remove the plate anodes from the cell, including cutting the plate anodes from a base plate. The anodes can then have the old coating removed by vigorous processing which may include abrasive blasting of the anode surfaces. Thereafter, a fresh coating is applied to the anode plates and then they are reinstalled in the cell, e.g., by welding again to the base plate.

It would be highly desirable to have a more expedient manner of refurbishing used electrodes. It would also be most desirable if such innovation could improve turn around time to reduce plant outages.

SUMMARY OF THE INVENTION

An innovation is now disclosed which greatly reduces turn around time in the refurbishing of electrodes in use in commercial operation. Not only is turn around time reduced, but also conventional processing steps, e.g., cutting and removal of old anodes, are eliminated. Thus, overall plant operating efficiencies and economies are enhanced.

In one aspect, the invention is directed to an electrode comprising an at least substantially flat inner plate member having front and back major faces and an edge, and an outer envelope member tightly encasing the inner plate member on at least the front and back major faces thereof. The outer envelope member is in sufficient contact with the inner plate member,such as by welding, to pass electrical current between the plate member and the envelope member, and a coating is present on the outer surface of the envelope member.

In another aspect, the invention is directed to the method of refurbishing a plate electrode having front and back major faces and an edge, with the refurbishing retaining the electrode in secured engagement to a current distributor, which method comprises covering the plate electrode with an outer envelope member, tightly engaging the outer envelope member with the plate electrode and establishing electrical connection between such outer envelope member and the plate electrode.

In yet another aspect, the invention is directed to an electrode cover comprising at least one generally elongated, hollow envelope member having inner and outer major faces, each envelope member having a hollow interior with the inner major face being present in such interior, the hollow interior being adapted for encasing an electrode which is in plate form, with there being a coating on such outer major face.

In a still further aspect, the invention is directed to a U-shaped electrode cover having a base member of short width dimension at the base of the U, with a side member having a long length dimension at each side of the base member for providing the U-shaped electrode cover, such cover having inner and outer major faces, with the outer face of at least one side member being adapted for facing engagement with a plate member, such side member having at least one side extension section providing a side member larger than the plate member.

DESCRIPTION OF THE PREFERRED EMBODIMENTS

Figure 2A:
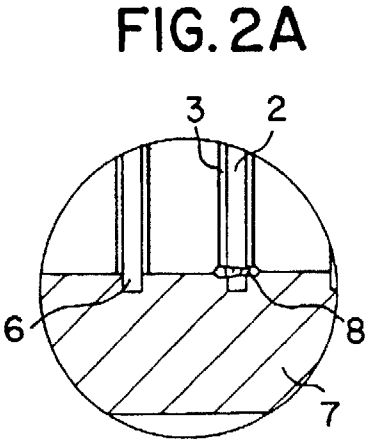
FIG. 2A is a section end view, for two electrodes as shown in FIG. 2, mounted in a base.

Electrodes which have been utilized commercially, typically as anodes, can be in plate form and usually will be referred to herein for convenience as being in "plate" form. However, it is to be understood that these electrodes can be appropriately considered to be in such form as bands, strips, sheets or blades. Moreover, it is further contemplated that with such plate form electrodes, the sheets may be perforated, e.g., as in the form of a mesh. The plate electrodes are at least substantially flat, that is, the working surface of the area is usually virtually completely flat, while a minor portion of the electrode, such as where the electrode might be attached to a current distributor, could be flanged or bent. In addition to being flat, the plate electrode is also non-circular, e.g., it will be rectangular rather than elliptical, in its general shape. The electrode as most often contemplated will be non-perforate and inflexible, i.e., solid and rigid, and have front and back major faces as well as an edge. When it is rectangular, the edge of the plate electrode will more particularly take the form of two sets of opposed parallel edges. If it is elongated and narrow, e.g., in the form of a strip or a blade, but in rectangular shape, it will have a parallel set of short edges and a parallel set of long edges. Usually one short edge will be affixed to a current distributor.

For the electrodes of the present invention, the inner plate member is as discussed above. Around it will be an outer envelope member. This may be referred to herein for convenience simply as the "envelope", or the "jacket" or the "cover" member. This cover member may be made at least substantially from plates, as will be discussed further hereinbelow, and the plates may be of the bands, strips, or sheets and the like as discussed hereinabove. The plates as most often contemplated will be non-perforated and inflexible, i.e., solid and rigid. These plates can have front and back major faces and an edge. Generally these plates will cover at least the front and back major faces of the plate electrode (FIG. 3) and welding may cover the edge (FIG. 5), as will be discussed hereinbelow. It is further also contemplated that the plates can be sheets which may be perforate, e.g., mesh. Both the inner plate member and the envelope member generally will be a metal member. Where the electrode is to be utilized in an electrolysis such as of brine, the metal for the inner plate member and outer envelope member is advantageously of a valve metal, e.g., titanium, tantalum, niobium, zirconium, hafnium, molybdenum, tungsten, or aluminum as well as alloys and intermetallic mixtures thereof. In such brine electrolysis, for both the inner plate and outer envelope, titanium is the preferred metal owing to its economical availability and desirable electrical and chemical properties.

The invention electrode may be useful in an electrolytic process as anode or cathode or both. However, for convenience, the electrode may often be referred to herein simply as the "anode". Representative electrolytic processes include the electrowinning of metals, electrodeposition of metals, electrolytic treatment of waste streams for removal of impurities, or for disinfection or the like, electrolysis of typically aqueous solutions of salts, such as electrolysis of brine, for the production of chlorine or chlorate.

Figure 1A:
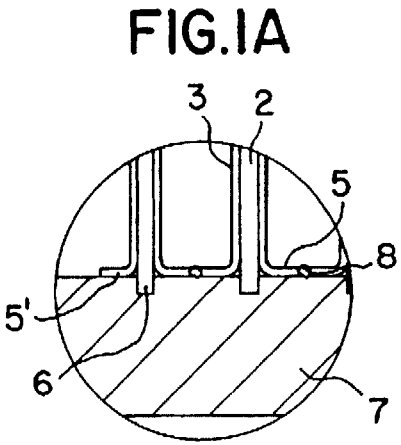
FIG. 1A is a section end view, for two electrodes as shown in FIG. 1, mounted in a base.
Figure 1:
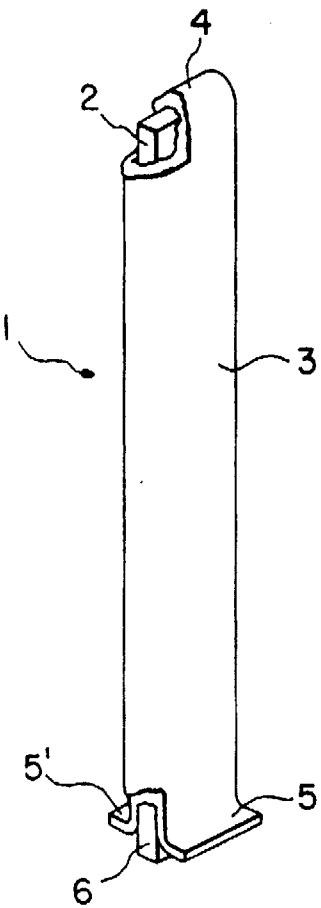
FIG. 1 is a perspective view, showing an electrode of the invention having an outer envelope encasing an inner electrode plate, the view being in partial cut-away.

Referring then to the drawings, and more particularly to FIG. 1, an invention electrode 1 has an inner plate 2 and an outer envelope 3. The inner plate 2 is provided by a used electrode in plate form. At the top portion of the inner plate 2 the outer envelope 3 has a cover section 4 which bridges over the top of the inner plate 2, thus covering the top of the inner plate 2. In the figure, a portion of the top section 4 and outer envelope 3 is shown in a partial cut-away view, exposing a top corner of the inner plate 2 for clarity. At the bottom of the electrode 1, the outer envelope 3 has flanges 5,5' which flare outwardly from the inner plate 2. Thus the outer envelope member is the outer envelope 3 including the cover section 4 and flanges 5,5'. Also at the bottom of the electrode, the outer envelope 3 stops short of the full extension of the inner plate 2 thereby exposing an extension portion 6 of the inner plate 2. At the bottom of the electrode 1, the outer envelope 3 has a partial cut-away view exposing the extension portion 6 for clarity. Except for the extension portion 6, the outer envelope 3 completely covers the inner plate 2.

Referring then to FIG. 1A, the inner plate 2 is covered with an outer envelope 3. At the base of the electrode, the inner plate 2 has an extension portion 6 which projects into, and is securely adhered to a base plate 7. The base plate 7 can serve as a current distributor. The lower end of the outer envelope 3 terminates in flanges 5,5'. These flanges 5,5' abut face to face to the base plate 7 and are secured thereto such as by welding 8 along their side edges to provide desirable electrical contact between the base plate 7 and the outer envelope 3. The welding 8 at the sides of the flanges 5,5' can also secure adjacent flanges 5,5' one to the other. Additional welding (not shown) can also be carried out completely across the front and back of the flanges 5,5', and therefore around the entire bottom perimeter of the outer envelope 3. By all of this welding, the envelope 3 is secured to the base plate 7. This perimeter welding can also seal completely the juncture of the envelope 3 with the base plate 7. The welding provides an electrical connection between the base plate 7 and the outer envelope 3.

Figure 2:
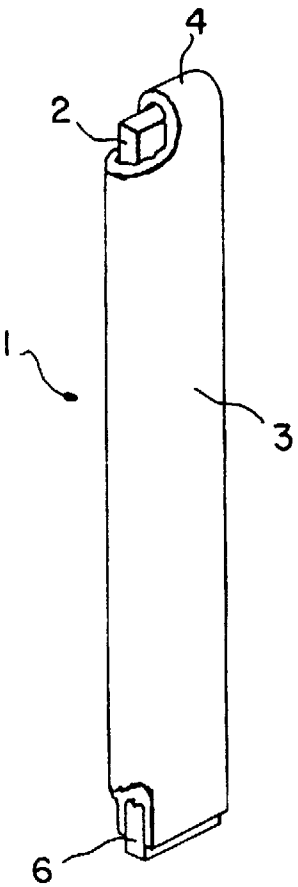
FIG. 2 is a perspective view, in partial cut-away, of a variation of an electrode of the invention.

Referring to FIG. 2, the electrode 1 has an inner plate 2 and an outer envelope 3. At the top portion of the inner plate 2 the outer envelope 3 has a cover section 4 (the inner plate 2 is shown at a cut-away portion, including a portion of this cover section 4), which bridges over the top of the inner plate 2, thus covering the top of the inner plate 2. At the bottom of the electrode, the outer envelope 3 stops short of the full extension of the inner plate 2. As shown partly in a cut-away section of the outer envelope 3, the inner plate 2 has an extension portion 6 projecting beyond the outer envelope 3. Except for the extension portion 6, the outer envelope 3 covers the inner plate 2.

Referring then to FIG. 2A, the inner plate 2 is covered with an outer envelope 3. At the base of the electrode, the inner plate 2 has an extension portion 6 which projects into, and is securely adhered, such as by welding, to a base plate 7. The base plate 7 can serve as a current distributor. At the lower end of the outer envelope 3, the envelope 3 terminates in edges which abut the base plate 7. The outer envelope 3 can be secured to the base plate 7 such as by welding 8 around the entire bottom perimeter of the outer envelope 3 where it adjoins the base plate 7. The entire perimeter welding 8 provides desirable electrical contact between the base plate 7 and the outer envelope 3. The inner plate 2 is then completely sealed by the outer envelope 3 and welding 8.

Figure 3:
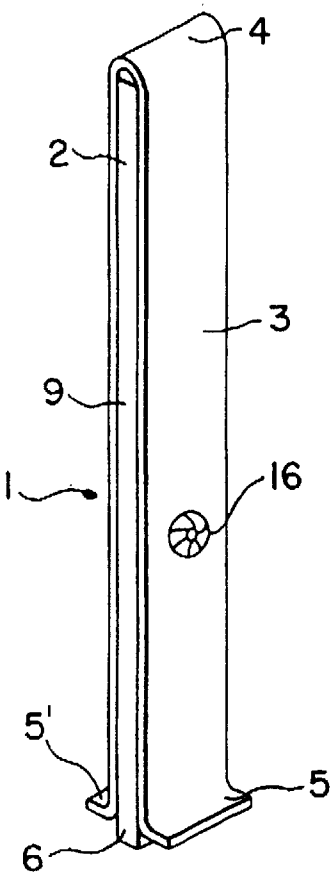
FIG. 3 is a perspective view of yet another electrode variation of the invention.

Referring then to FIG. 3, the electrode 1 has an inner plate 2 and an outer envelope 3. This envelope 3 has an elongated (long length dimension) element on each side of the plate 2. At the top portion of the inner plate 2 the outer envelope 3 has a cover section 4 which bridges between the two elongated elements (each of which are substantially plate shaped), and the cover section 4 also bridges over the top of the inner plate 2, thus covering the top of the inner plate 2. However, long parallel edges 9 of the inner plate 2 (which edges 9 define the thickness dimension of the inner plate 2) are left exposed by the version of the envelope 3 shown in FIG. 3. These edges 9 can be sealed, such as by welding (not shown). Along the outer face of one of the elongated elements of the envelope 3 there is placed a separator 16. This can serve to maintain a separation between the electrode 1 and adjacent assembly. The separator 16 can be secured to the envelope 3, such as by adhesive, and may be made from a material resistant to the environment of the electrode, which material may suitably be polytetrafluoroethylene.

At the bottom of the electrode 1, each of the elongated elements terminates in a flange 5,5', or foot. Each of the flanges 5,5' flare outwardly from the inner plate 2. Moreover at the bottom of the electrode 1, the outer envelope 3 stops short of the full extension of the inner plate 2 thereby exposing an extension portion 6 of the outer envelope 3. The outer envelope 3 is in secure, electrically conductive contact with a base plate (note shown) such as in the manner shown and described hereinabove in connection with FIGS. 1 and 1A. Where welding is used along the outer edges 9, this welding (not shown) plus the outer envelope 3, can assist in completely sealing the inner plate 2. In such instances, it is the envelope 3 plus welding that completely covers the inner plate 2.

Figure 4A:
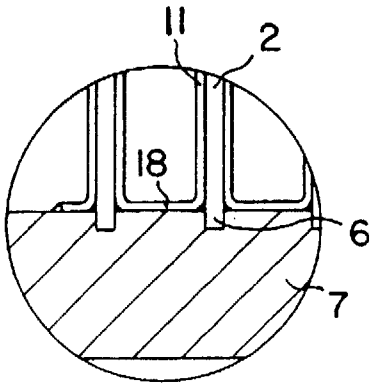
FIG. 4A is a section end view for the electrodes of FIG. 4 mounted in a base.
Figure 4:
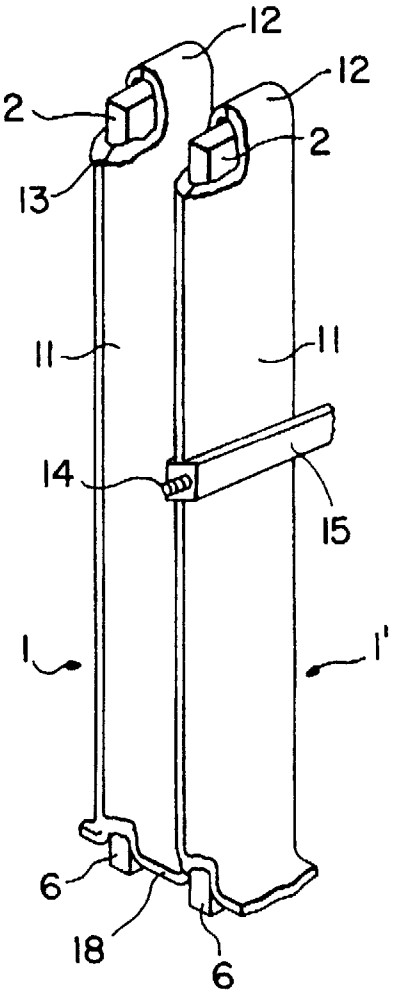
FIG. 4 is a perspective view of two electrodes, spaced apart, each in partial cut-away.

Referring next to FIG. 4, two electrodes 1,1' each have an inner plate 2. This plate 2 is essentially encased in envelope sections 11. At the top portion of the inner plate 2 each envelope section 11 has a top extension section 12 which extends past the top end of the inner plate 2 (which is shown in partial cut-away of the envelope sections 11). Also, the envelope sections 11 have side extension sections 13 which extend past the side edge of the inner plate 2. Where the extension sections 12,13 of adjacent envelope sections 11 come together, they pinch together leaving only a seam and can be secured together, e.g., in sealing engagement, such as by welding (not shown) along the seam. At the bottom, between the two electrodes, a facing pair of long length dimension envelope sections 11 interconnect at a base 18 (at the side edges of the base 18). This base 18 has a short width dimension between the adjacent inner plates 2. The short width dimension base 18 with the long envelope sections 11 form a U-shaped cover member segment. The inner envelope sections 11 provide elongated side members at each side of the base 18. These envelope sections 11, on their outer faces, are in facing engagement with inner plates 2. These envelope sections 11, on their inner faces, can be coated. These sections plus the base (and which may include the extension sections 12, 13) can form a seamless, one-piece U-shaped cover member.

At the bottom of each electrode, the outer envelope sections 11 stop short of the full extension of the inner plate 2 thereby exposing an extension portion 6 of the inner plate 2 (as shown in partial cut-away of the envelope sections 11). An adjacent pair of the outer envelope sections 11, including the extension sections 12, 13, when sealed together as by welding, can completely cover the inner plate 2 of each electrode, except for the exposed extension portion 6. Also secured at the side extension sections 13 can be support pins 14. These pins 14 support electrically non-conductive, e.g., polytetrafluoroethylene, separator strips 15 which can serve to maintain the electrode separate from an adjacent electrode. The separator strips 15 can be formed with bent edges and apertures which fit around the support pins 14, whereby the separator strips can be snapped into place over the support pins 14. The separator strips 15 may also be adhesively held in place, thereby obviating the support pins 14.

Referring then to FIG. 4A, each inner plate 2 is covered with a pair of outer envelope sections 11. At the bottom of the envelope sections 11, the base 18 outer surface is in contact with a base plate 7. At the base of each electrode, the inner plate 2 has an extension portion 6 which projects into, and is securely adhered to, such as by welding, a base plate 7. The bottom of the envelope sections 11 can be welded to the base plate 7 at the front and back of the extension portion 6, i.e., across the width of the plate 2, in the manner as shown in FIG. 2A. The base plate 7 can serve as a current distributor.

Figure 5:
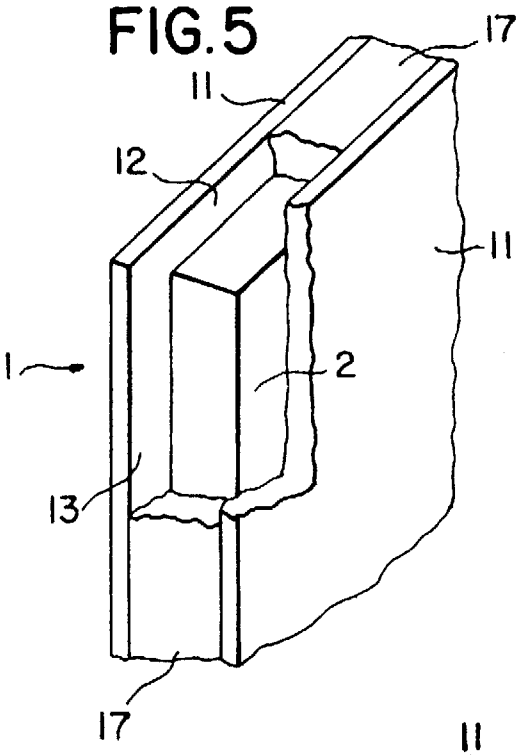
FIG. 5 is a perspective view of a top corner section of an electrode, showing a plate-and-envelope variation in partial cut-away.

Referring then to FIG. 5, an electrode 1 has an inner plate 2. This plate 2 is snugly sandwiched between envelope sections 11. At the top portion of the inner plate 2 each envelope section 11 has a top extension section 12 which extends past the top end of the inner plate 2. Also the envelope sections 11 have side extensions sections 13 which extend past the side edge of the inner plate 2. These side extension sections 13 can extend past the side edge of the plate 2 at both the front and back of the plate 2. Where the extension sections 12, 13 of the adjacent envelope sections 11 face one another, they can be secured together in sealing engagement by welding 17 across the entire width of the edges of the inner plate 2. This welding 17 can be along the long parallel side edges, both front and back, between the side extension sections 13, as well as along the top short edge between the top extension sections 12. The bottom short edge of the inner plate 2 can be affixed to the base plate 7 (FIG. 4A). For this construction, the cover member is thus provided not only from the envelope sections 11, but also by the welding 17 at three sides of the inner plate 2.

To refurbish old electrodes, even those containing residual surface coating, the electrodes as inner plates 2 can be retained in a base plate 7 and need not have old coating removed. For purposes of this exemplification, and referring more particularly to FIGS. 4 and 5, U-shaped cover member segments of a base 18 and side envelope sections 11 can be fitted between adjacent inner plates 2. In this fitted engagement, the outer face of the base 18 can be fitted in firm contact against the base plate 7. Also, outer faces of envelope sections 11 can fit firmly against adjacent faces of inner plates 2. All such firm engagement enhances electrical connections between the envelope sections 11 and the inner plates 2. Welding 17 can then be provided along the exposed edges of the inner plates 2, with preferably the plate extension sections 12, 13 providing some to all of the weld metal. Thus, in addition to any of the above discussed mechanical engagement that occurs by the fitting of the U-shaped cover member segments between adjacent inner plates 2, there is additionally good metallurgical connection between the inner plates 2 and the U-shaped cover member segments which can be provided by the welding 17. This metallurgical and mechanical engagement provides for a desirable electrical connection between the outer envelope sections 11 and the inner plates 2.

Referring again to FIG. 1, and as mentioned hereinabove, both the inner plate member 2 and the outer envelope 3 are generally metal members, typically valve metal members with titanium being preferred. Titanium is also the preferred metal where the outer envelope is in envelope sections 11 as shown in FIG. 4. The outer surface of the outer envelope 3, or envelope sections 11, will advantageously be electrocatalytically coated, with a coating as will be discussed further hereinbelow in greater detail. As noted in the FIGS. 1 and 1A, the outer envelopes 3 can be individual hollow envelope members of inverted U-shapes. They will have a hollow interior having an inner face for contacting an inner plate 2. Such hollow envelopes are placed over the inner plates 2 and welded together between adjacent plates as well as to the inner plate 2 after placement, e.g., the welding 8 of FIG. 1A and 2A. It is also contemplated that the outer envelopes 3, as well as the envelope sections 11 of FIG. 4, can be preformed. That is, prior to placement over the inner plates 2, these envelopes 3 can be secured together as by welding or in seamless connection to form large, one-piece structures of, e.g., many envelopes 3 welded together. Such large structures may then be slipped over many inner plates 2, such as rows of inner plates 2. Such large preformed structures will also be serviceable where the outer envelope 3 is in the form as shown in FIG. 3.

As noted in FIG. 4, the outer envelopes can be in sections, including extension sections 12, 13 as shown in FIG. 5. Advantageously, these sections will be preassembled or formed into one piece. For example, a base 18 can have a side envelope 11 welded at each side edge to form a U-shaped envelope cover member. The extension sections 12,13 can be welded to the side envelope 11. The resulting member, with weld seams, is then slipped between adjacent plates 2. Such a member may also be formed as a seamless, one-piece segment of the overall envelope that likewise can be slipped between adjacent plates 2. Other configurations for structuring envelope sections are also contemplated, such as having sections where the weld joints are down the broad face of the inner plate 2 rather than at the short sides thereof. Also, other connections for the inner plates 2 with a base plate 7 rather than an extension portion 6 projecting into the base plate 7, are contemplated. For example, the inner plates 2 may be flanged and secured to current lead-in members, such as shown in U.S. Pat. No. 4,078,986.

Wherever welding is utilized, the type of welding is preferably gas tungsten arc welding or tungsten and inert gas welding, but other welding techniques such as electron beam may be utilized. The deposited metal remaining after the welding will most always be left as is, but can also be subject to further operation, e.g., machined, polished or trimmed.

In a cell such as for the electrolysis of brine to produce chlorate, the inner plates 2 at their edge will typically have a width (thickness) on the order of 0.1 inch. For such inner plates 2, it is contemplated that the outer envelope 3, at each side of the inner plate 2 will have a thickness dimension on the order of from bout 0.02 inch to about 0.04 inch. Although the outer envelopes 3 and envelope sections 11 have been shown in the figures to be solid, it is also contemplated that the envelope 3 and sections 11 may be in mesh form. The securing, as by welding, of the mesh form cover can provide for desirable electrical connection without the need for providing a sealing of the inner plate 2. Although discussions have been made hereinbefore typically pertaining to a base plate 7, it is to be understood that other structure, e.g., bar shape, is contemplated for the base. In general it is contemplated that any base structure which can be utilized for plate anodes, will be serviceable as the base structure in the present invention. Usually such base structure will be metallic and made from an electrically conductive metal such as titanium or steel. In FIG. 4 the support pins 14 are typically metallic and are made of a metal similar to the plate 2, e.g., titanium. Affixed to these pins 14, such as by being snapped in place, are the separator strips 15. These are electrically non-conductive separator strips typically made from a polymeric material such as polytetrafluoroethylene.

Since the inner plates 2 can be old electrodes, which may contain at least some residual coating, it is preferred for enhanced current distribution that the cover structure be as shown in FIG. 5. Welded regions can provide good current distribution, which in part will be due to the welded areas providing firm contact to the inner plates 2, even through an old, residual coating. In the structure of FIG. 5, the welding 17 provides current distribution to three edges of the inner plate 2 (the fourth edge of the inner plate 2 being secured to a base plate 7). Moreover, the welding 17 in FIG. 5 is between the extension sections 12, 13, which provides for comparative ease of welding, when compared with the welding between flanges 5,5' adjacent a base plate 7 (FIG. 1A). Wherever applied, the welding can provide a desirable seal, e.g., between envelope sections 11, for reducing to eliminating crevice corrosion. With the structure of FIG. 5, because of the extension sections 12, 13 of the envelope sections 11, a welding arc can be struck to an edge of the inner plate 2. This can be utilized to affect pooling of the metal of the extension sections 12 at the top edge of the inner plate 2. In this manner, the metal of the weld 17 is contributed in whole or in part from such extension sections 12. A similar result can be achieved for the weld 17 along the front and back edges of the inner plate 2 for the side extension sections 13. Using this technique, no additional metal need be contributed for the welding.

As representative of the electrochemically active coatings that may be applied to the outer surface of the outer envelope 3 or envelope sections 11 are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385, and 4,528,084. The mixed metal oxide coatings can often include a platinum group metal including platinum, palladium, rhodium, iridium and ruthenium or mixtures of these as well as mixtures with other metals. Further coatings can comprise tin oxide, manganese dioxide, lead dioxide, cobalt oxide, ferric oxide, platinate coatings such as $M_xPt_3O_4$ where M is an alkali metal and X is typically targeted at approximately 0.5, nickel-nickel oxide and nickel plus lanthanide oxides.

We claim:

1. An electrode comprising an inner titanium member of an at least substantially flat, inner titanium plate member having front and back major faces and an edge, an outer cover member of titanium sheet in mesh form, with said titanium mesh tightly engaging said inner titanium plate member on at least the front and back major faces thereof, to pass electrical current between said inner titanium plate member and said outer titanium sheet in mesh form, and a coating on an outer surface of said outer titanium sheet in mesh form.

2. The electrode of claim 1, wherein said inner plate member is a non-perforate, solid and inflexible metal member.

3. The electrode of claim 1, wherein said inner titanium plate member is a non-circular plate member, has at least two sets of opposed parallel edges, and is of a metal selected from the group consisting of titanium, tantalum, niobium, zirconium, hafnium, molybdenum, tungsten, aluminum, their alloys, and intermetallic mixtures thereof.

4. The electrode of claim 3, wherein said two sets of opposed parallel edges consist of a parallel set of short edges and a parallel set of long edges.

5. The electrode of claim 3, wherein at least said set of long edges is exposed by said cover member.

6. The electrode of claim 3, wherein one short edge is connected with a current distributor means for said electrode.

7. The electrode of claim 6, wherein said cover member is secured to said current distributor means by welding, and welding covers exposed edges of said inner titanium plate member.

8. The electrode of claim 1, wherein said titanium sheet in mesh form comprises a sheet of titanium mesh on the front major face of said inner titanium plate member, plus a sheet of titanium mesh on the back major face of said titanium plate member.

9. The electrode of claim 1, wherein said cover member has flanged lower edges in face-to-face contact with current distributor means for said inner titanium plate member.

10. The electrode of claim 1, wherein said cover member has top and side extension sections.

11. The electrode of claim 10, wherein said cover member is welded to said inner titanium plate member, which welding includes welding of said extension sections.

12. The electrode of claim 1, wherein said cover member is comprised of segments.

13. The electrode of claim 1, wherein said cover member is a metal member, and is of a metal selected from the group consisting of titanium, tantalum, niobium, zirconium, hafnium, molybdenum, tungsten, aluminum, their alloys, or intermetallic mixtures thereof.

14. The electrode of claim 1, wherein said inner titanium plate member is a perforate metal member.

15. The electrode of claim 1, wherein said cover member is a titanium metal anode member having an electrocatalytic coating on the outer surface thereof.

16. The electrode of claim 15, wherein said electrocatalytic surface coating contains at least one oxide selected from the group consisting of platinum group metal oxides, magnetite, ferrite and cobalt oxide spinel.

17. The electrode of claim 15, wherein said electrocatalytic surface coating contains a mixed crystal material of at least one oxide of a valve metal and at least one oxide of a platinum group metal.

18. An electrolytic cell utilized for the electrolysis of brine and containing an electrode comprising an inner member of an at least substantially flat, inner titanium plate member having front and back major faces and an edge, an outer cover member of titanium sheet in mesh form, with said titanium mesh tightly engaging said inner titanium plate member on at least the front and back major faces thereof, to pass electrical current between said inner titanium plate member and said outer titanium sheet in mesh form, and a coating on an outer surface of said outer titanium sheet in mesh form.

19. The cell of claim 18 wherein said cell contains chlorate.

20. The method of refurbishing a plate electrode having front and back major faces and an edge, with the refurbishing retaining the electrode in secured engagement to a current distributor, which method comprises:

establishing outer envelope members on the major faces of said plate electrode, said outer envelope members having extension sections projecting beyond the perimeter of said plate electrode, with said extension sections leaving exposed edges of said plate electrode;

striking a welding arc between said extension sections to an exposed edge of said plate electrode to provide a weld along said exposed edge; and pooling metal of said extension sections at said welding arc, thereby providing said weld at the plate electrode edge of extension section metal.

* * * * *

UNITED STATES PATENT AND TRADEMARK OFFICE

CERTIFICATE OF CORRECTION

PATENT NO. : 5,783,053

DATED : July 21, 1998

INVENTOR(S) : Charles P. Tomba et al

It is certified that error appears in the above-identified patent and that said Letters Patent is hereby corrected as shown below:

Column 8, in claim 3, starting at line 53, after "titanium," insert --its alloys-- and thereafter delete "tantalum, niobium, zirconium, hafnium, molybdenum, tungsten, aluminum, their alloys,".

Column 9, in claim 13, line 17, after "is", first occurrence, delete "a metal member, and is";

lines 18-19, after "titanium," insert --its alloys and-- and delete "tantalum, niobium, zirconium, hafnium, molybdenum, tungsten, aluminum, their alloys, or".

Signed and Sealed this

Twenty-fourth Day of November, 1998

Bruce Lehman

*Attest:*

BRUCE LEHMAN

*Attesting Officer*

*Commissioner of Patents and Trademarks*